US007861706B2

(12) United States Patent
Bellomo

(10) Patent No.: US 7,861,706 B2
(45) Date of Patent: Jan. 4, 2011

(54) GAS MANIFOLD FOR A COOKING RANGE, WITH A PIPE CLOSURE

(75) Inventor: Alberto Bellomo, Ponzano (IT)

(73) Assignee: Coprecitec, S.L., Aretxabaleta (ES)

( * ) Notice: Subject to any disclaimer, the term of this patent is extended or adjusted under 35 U.S.C. 154(b) by 424 days.

(21) Appl. No.: 11/492,503

(22) Filed: Jul. 24, 2006

(65) Prior Publication Data

US 2007/0028915 A1 Feb. 8, 2007

(30) Foreign Application Priority Data

Aug. 3, 2005 (ES) ..... 200501945

(51) Int. Cl.
*F24C 3/00* (2006.01)

(52) U.S. Cl. ..... 126/39 N; 228/114.5; 72/370.12; 72/370.1; 72/67

(58) Field of Classification Search ..... 251/9; 294/115; 269/32; 126/39 N; 72/122, 82, 72/370.12, 370.13, 370.14, 370.15
See application file for complete search history.

(56) References Cited

U.S. PATENT DOCUMENTS 1,458,196 A * 6/1923 Pickup ..... 126/42
1,701,411 A * 2/1929 Kellam ..... 251/9
1,877,342 A * 9/1932 Malby ..... 72/341
2,136,007 A * 11/1938 Gish ..... 222/92
2,212,801 A * 8/1940 Torbert ..... 81/426
2,406,059 A * 8/1946 Burch ..... 228/173.2
2,408,596 A 10/1946 Bednar et al.
2,421,629 A * 6/1947 Langos ..... 72/356
2,524,420 A * 10/1950 Blampin ..... 72/95
2,663,206 A * 12/1953 Whiting et al. ..... 228/2.3
2,699,596 A * 1/1955 Aronson ..... 72/82
2,709,381 A * 5/1955 Enghauser ..... 228/2.3
2,754,705 A * 7/1956 Enghauser ..... 228/2.3
2,825,525 A * 3/1958 Kellam ..... 251/9
2,896,975 A * 7/1959 Wahl et al. ..... 285/219
2,971,554 A * 2/1961 Knox ..... 72/356
3,090,263 A * 5/1963 Laverty et al. ..... 228/2.3

(Continued)

FOREIGN PATENT DOCUMENTS

EP 0769337 A1 4/1997

(Continued)

*Primary Examiner*—Kenneth B Rinehart
*Assistant Examiner*—Jorge Pereiro
(74) *Attorney, Agent, or Firm*—Tim L. Kitchen; Peter B. Scull; Berenbaum Weinshienk PC

(57) ABSTRACT

The gas manifold (1) adapted for installation on a cooking range includes a conduit (2) for distribution of a flow (Q) at a pressure "P", with a number of regulating taps (5) fixed to the conduit (2). The conduit is made from a metal pipe (3) with a thin cylindrical wall To and the pipe end (6) is sealed without cracks by means of friction welding with no addition of material, with a sealing wall (7) formed by means of a thickening in the form of a tip (7*a*) in the axial direction of an enlargement or height "H" greater than the original thickness To of the pipe. For making the gastight closure a rotary tool (8) is used that includes at least two rotary rollers (9) for the compaction of the metallic mass between two counterposed centripetal forces (Fr), in combination with an axial stretching force (Fa).

12 Claims, 1 Drawing Sheet

U.S. PATENT DOCUMENTS

| | | | | | |
|---|---|---|---|---|---|
| 3,094,349 | A | * | 6/1963 | Schwalm | 294/115 |
| 3,145,465 | A | * | 8/1964 | Coolidge, Jr. et al. | 228/196 |
| 3,225,998 | A | * | 12/1965 | Bowman | 228/2.3 |
| 3,260,098 | A | * | 7/1966 | Gill | 72/416 |
| 3,475,786 | A | * | 11/1969 | Pearson | 425/150 |
| 3,496,747 | A | * | 2/1970 | Delmer et al. | 72/81 |
| 3,748,883 | A | * | 7/1973 | Ashizawa et al. | 72/81 |
| 3,793,863 | A | | 2/1974 | Groppini | |
| 4,061,009 | A | * | 12/1977 | Kaporovich et al. | 72/69 |
| 4,083,677 | A | * | 4/1978 | Hovis | 432/19 |
| 4,181,491 | A | * | 1/1980 | Hovis | 431/187 |
| 4,304,433 | A | * | 12/1981 | Langowski | 294/106 |
| 4,320,848 | A | * | 3/1982 | Dye et al. | 220/669 |
| 4,439,274 | A | * | 3/1984 | Goossens et al. | 201/41 |
| 4,502,310 | A | * | 3/1985 | Gnutov et al. | 72/69 |
| 4,604,051 | A | * | 8/1986 | Davies et al. | 431/166 |
| 4,627,257 | A | * | 12/1986 | McElhaney | 72/102 |
| 5,071,102 | A | * | 12/1991 | Gray | 251/4 |
| 5,085,131 | A | * | 2/1992 | Barrett et al. | 92/169.1 |
| 5,273,252 | A | * | 12/1993 | Brugalieres et al. | 251/9 |
| 5,333,485 | A | * | 8/1994 | Ublacker | 72/370.12 |
| 5,598,729 | A | * | 2/1997 | Hoffmann et al. | 72/8.5 |
| 5,845,527 | A | * | 12/1998 | Hoffmann et al. | 72/69 |
| 6,000,933 | A | * | 12/1999 | Frederick, Sr. | 431/278 |
| 6,169,268 | B1 | * | 1/2001 | Esterline et al. | 219/125.11 |
| 6,237,638 | B1 | | 5/2001 | Asta et al. | |
| 6,467,322 | B2 | * | 10/2002 | Nogami et al. | 72/121 |
| 6,578,532 | B1 | * | 6/2003 | Rowley | 123/25 R |
| 6,725,698 | B2 | * | 4/2004 | Endo | 72/120 |
| 6,758,077 | B2 | * | 7/2004 | Kaneko | 72/85 |
| 6,766,675 | B2 | * | 7/2004 | Suzuki et al. | 72/121 |
| 7,195,035 | B2 | * | 3/2007 | Pechtold | 137/625.44 |
| 2004/0181926 | A1 | * | 9/2004 | Dion et al. | 29/434 |

FOREIGN PATENT DOCUMENTS

| | | | |
|---|---|---|---|
| EP | 1488870 | A1 | 12/2004 |
| JP | 59125220 | A | 7/1984 |

* cited by examiner

GAS MANIFOLD FOR A COOKING RANGE, WITH A PIPE CLOSURE

The present invention relates to a gas manifold with a number of regulating taps installed on a flow distributor pipe, wherein one of the ends of the manifold pipe is sealed hermetically.

PRIOR ART

Fuel gas manifolds fitted with rotary type manual taps are already known. They are installed on a panel of the frame of the cooking appliance with the control shafts of the taps aligned on a front panel of the cooking appliance. One of the ends of the manifold pipe is open for the connection of a hose for the supply of the fuel gas to the manifold, while the opposite end is sealed hermetically to prevent any leakage of gas. The gas flow manifold is preferably made of a long thin-wall pipe, made of aluminium or steel alloy with corrosion-resistant aluminium. The thinnest possible thickness of the wall on each of the pipes is determined in accordance with the strength required for handling and/or the strength necessary for machining and connection of the taps to the manifold conduit. The end of the pipe may be sealed for instance by means of the formation of the circular wall of the pipe and the closure finished off in the middle of the diameter by means of a welding with addition of metal.

A known example of a gas manifold for a cooking appliance is disclosed in U.S. Pat. No. 6,237,638-B1, wherein the manifold pipe is sealed at one end by means of an operation of rotation of a tool or roller working in the inward radial direction of the pipe, while the central region is welded by means of a process of compacting the fused metal in order to assure an airtight seal in the centre of the end wall.

A further example of a seal on a metal pipe is disclosed in JP-59125220, with a method for the sealing of an end of alloy pipe by means of the rotation of a roller, which generates the softening temperature of the metal, due to friction with the wall of the pipe, and the wall is therefore deformed inwards in a radial direction, until achieving the complete closure of the end of the pipe without addition of metal.

In the examples quoted from the prior art the resultant thickness of the closure wall after compacting the metal, although greater than the original thickness of the pipe, is not sufficient to assure a weld in the central region without gas leakage.

DISCLOSURE OF THE INVENTION

The object of the invention is a gas manifold fitted with a number of manual taps interspaced along the distributor conduit made of aluminium, or a similar corrosion-resistant alloy and adapted for the supply of a gas flow to a cooking appliance, wherein the opposite end of the pipe is sealed hermetically without addition of metal by means of the radial compaction of the wall of the end of the pipe softened by the friction of at least one rotation tool, wherein the wall of the closure is assured in order to withstand the pressure of the gas flow without any leakage.

The closure of the end of an alloy distributor pipe must be a wall without any cracks and, in particular, its central region must be controlled, which has to be of a sufficient thickness to eliminate cracks and thereby be able to withstand the pressure of the gas flow without any gas leakage whatsoever.

The gastight seal of the pipe end achieved according to the invention, results with a wall thickness greater than that of the original pipe and, in particular, in its central region it is of a thickness considerably greater enlarged with a tip, which withstands the real pressure of the gas flow distributed and assures the tightness in all the pipe closures made.

DETAILED DESCRIPTION OF AN EMBODIMENT

Figure 1:
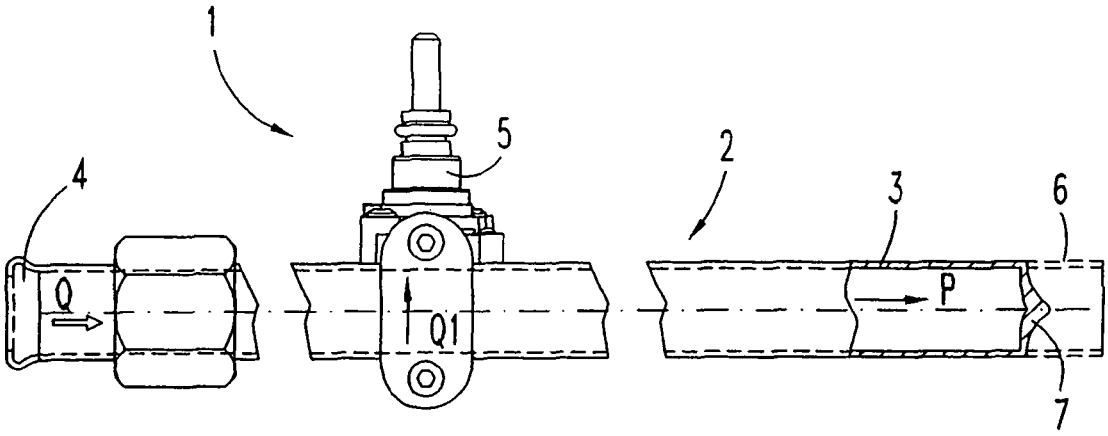
FIG. 1 is a view of a gas manifold for a cooking appliance, with a closure at one end of the tubular conduit.
Figure 2:
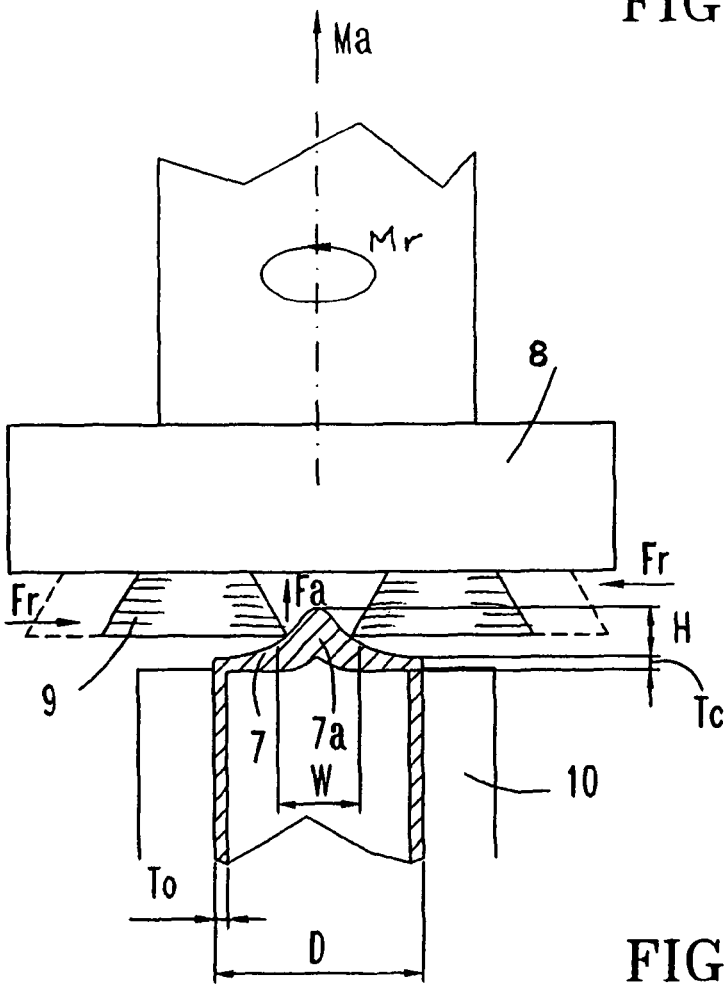
FIG. 2 is a partial view of the end of the distributor pipe of FIG. 1, showing the form of the closure and the rotary tool used to produce it.

In reference to FIG. 1 and FIG. 2, an embodiment of gas manifold 1 for installation on a cooking range comprises a distributor conduit 2 made by means of a long, thin-wall alloy pipe 3, preferably of cylindrical cross section, with an open end 4 of the conduit for the intake of a flow Q for the gas supply of the cooking range at a pressure "P", a number of regulating taps 5 which distribute the partial flows Q1 supplied to the range and an end 6 of the pipe with an end closure 7, which has been formed for safety against leakage of gas of said flow Q at pressure "P". A cylindrical pipe 3 is made in particular of an alloy with a low softening temperature such as aluminium or corrosion-resistant aluminized steel. The pipe 3 is chosen of a diameter "D" in keeping with the regulating tap model 5 and its fastening to the distributor conduit 2. For economic reasons the thinnest possible original pipe wall thickness "To" is chosen, capable of conferring on pipe 3 the strength necessary for its handling. The small metallic mass of the end 6 of formed pipe also simplifies the closure operation carried out as described below by means of friction until achieving a temperature for the softening of the metal in the circular aluminium wall "To". The original alloy pipe for carrying out the distributor conduit 2 is free of welds and does not corrode, so its wall is gastight in itself.

In FIG. 1 the end of pipe 6 prior to the closure operation is represented with a dash line. As a result of the forming tool 8 used to execute the closure 6, provided with two rotary rollers 9 that operate from two opposite sides of the pipe end 6, the latter is converted into a closure wall 7, wherein the circular edge of the end 6 of the pipe has been welded. The average thickness "Tc" of the closure wall is greater than the original thickness "To", and in its central region a tip 7*a* is formed of greater metal mass in relation to the peripheral closure wall 7. The thickness or height "H" of the tip intentionally pronounced in order to carry out a compaction of the metal free of cracks in the central region 7*a* of the closure.

To carry out the operation for the sealing of the end of the pipe 6, the original pipe 3 is positioned in a fastening device 10, which leaves the end of pipe 6 protruding as represented in FIG. 1. The forming tool 8 is positioned encircling the end of pipe 6. The forming tool has to be provided with at least two rollers 9 in order to carry out said thickening of the tip wall 7*a* in the central region of the closure. Thus, the forming tool carries out a traversing movement "Ma" and a rotation movement "Mr", while the rollers 9 rotate at sufficiently high speed to the friction heat required to soften the wall metal of the end 6 and to carry out the compaction process.

By means of a combination of the axial movement Ma and the rotational movement Mr made by the compaction tool 8, both rollers 9 exert (FIG. 2) a centripetal radial force "Fr" at the same time as an axial force "Fa" against the aluminium mass conferring the form of a tip 7*a* on the closure wall, the cross section of which, as shown in FIG. 2, has said thickening or tip 7*a* of height "H", considerably larger than the original thickness "To" of the wall of pipe 3. The conical form acquired by said closure tip 7*a* is the resultant effect of the counterposed gripping forces "Fr" on the metallic mass exerted between the two rollers 9, the edges of which go on making contact at different heights of said tip 7*a* in line with the axial movement "Ma". As a result of the compaction pressure exerted on the softened metal between the two rollers, the pipe end closure is assured of being free of cracks and completely sealed at an actual pressure of the gas flow Q. In the preferred embodiment described here, we have a base "W" of said tip 7*a* whose size in relation to the original thickness "To" of the pipe is around W=6×To and the height of the section of the tip 7*a* is around H=3×To.

What it is claimed is:

1. A gas manifold for a cooking appliance comprising: a pipe having an open first end and a hermetically sealed second end, a longitudinal length of the pipe adjacent the sealed second end having a first wall thickness, the sealed second end comprising a closure wall of non-uniform curvature, the closure wall having a central conical wall portion that is annularly bound by a concave wall portion, the average thickness of the closure wall being greater than the first wall thickness.

2. A gas manifold according to claim 1, wherein the closure wall has a central tip region having a width dimension (W) and a height dimension (H), the width dimension of the central tip region being greater than the height dimension of the central tip region.

3. A gas manifold according to claim 1, wherein the closure wall has a central tip region having a height dimension (H) considerably larger than the first wall thickness.

4. A gas manifold according to claim 1, wherein the closure wall has a central tip region having a height dimension (H) around three times the first wall thickness.

5. A gas manifold according to claim 1, wherein the closure wall has a central tip region having a base dimension (W) around six times the first wall thickness.

6. A gas manifold according to claim 1, wherein the closure wall has a central tip region having a base dimension (W) around six times the first wall thickness and a height dimension (H) around three times the first wall thickness.

7. A gas manifold according to claim 1, wherein the pipe is made of aluminium or a steel alloy comprising corrosion-resistant aluminium.

8. A gas manifold according to claim 1, wherein the pipe is made of a low softening temperature metal alloy.

9. A gas manifold for a cooking appliance comprising: a pipe made of a low softening temperature metal alloy and having an open first end and a hermetically sealed second end, a longitudinal length of the pipe adjacent the sealed second end having a first wall thickness, the sealed second end comprising a closure wall of non-uniform curvature, the closure wall having a central conical wall portion that is annularly bound by a concave wall portion, the average thickness of the closure wall being greater than the first wall thickness, the closure wall having a pronounced central tip region, the central tip region having a height dimension (H) that is considerably larger than the first wall thickness.

10. A gas manifold according to claim 9, wherein the central tip region has a height dimension (H) around three times the first wall thickness.

11. A gas manifold according to claim 9, wherein the central tip region has a base dimension (W) around six times the first wall thickness.

12. A gas manifold according to claim 9, wherein the central tip region has a base dimension (W) around six times the first wall thickness and a height dimension (H) around three times the first wall thickness.

* * * * *